US007986281B2

(12) United States Patent
Hsiao et al.

(10) Patent No.: US 7,986,281 B2
(45) Date of Patent: Jul. 26, 2011

(54) MULTI-BAND ANTENNA

(75) Inventors: Lan-Yung Hsiao, Taipei Hsien (TW); Pei-Fen Wu, Taipei Hsien (TW); Yu-Yuan Wu, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 422 days.

(21) Appl. No.: 12/354,952

(22) Filed: Jan. 16, 2009

(65) Prior Publication Data

US 2010/0182215 A1 Jul. 22, 2010

(51) Int. Cl.
*H01Q 1/48* (2006.01)

(52) U.S. Cl. ..... 343/846; 343/700 MS; 343/702; 343/893

(58) Field of Classification Search ..... 343/700 MS, 343/702, 745, 845, 846, 847, 848, 893
See application file for complete search history.

(56) References Cited

U.S. PATENT DOCUMENTS 6,166,694 A * 12/2000 Ying ..... 343/702
6,734,825 B1 * 5/2004 Guo et al. ..... 343/700 MS
7,256,743 B2 * 8/2007 Korva ..... 343/702
7,432,861 B2 * 10/2008 Shih ..... 343/700 MS
7,479,928 B2 * 1/2009 Tan et al. ..... 343/702
7,525,488 B2 * 4/2009 Rowell ..... 343/700 MS

* cited by examiner

*Primary Examiner* — Douglas W Owens
*Assistant Examiner* — Chuc D Tran
(74) *Attorney, Agent, or Firm* — WPAT, P.C.; Anthony King

(57) ABSTRACT

A multi-band antenna includes a first radiating portion, a second radiating portion extending perpendicularly from the first radiating portion, a third radiating portion extending perpendicularly from the second radiating portion and located at a same side with respect to the second radiating portion as the first radiating portion, a fourth radiating portion extending perpendicularly from the third radiating portion towards the first radiating portion, a fifth radiating portion in alignment with the first radiating portion, with a feeding portion connecting with the first radiating portion and the fifth radiating portion, a sixth radiating portion extending perpendicularly towards the fourth radiating portion from the fifth radiating portion and spaced away from the fourth radiating portion, and a grounding portion spaced from the first radiating portion, the feeding portion and the fifth radiating portion with a grounding area disposed thereon, and connected with the first radiating portion by a connecting portion.

8 Claims, 3 Drawing Sheets

| | | | | |
|---|---|---|---|---|
| 1 | 825MHz | 127.67Ω | −13.048Ω | 14.785pF |
| 2 | 895MHz | 18.748Ω | 10.808Ω | 1.9219nH |
| 3 | 1.85GHz | 83.478Ω | −3.1996Ω | 26.888pF |
| 4 | 1.99GHz | 68.364Ω | −4.6056Ω | 17.365pF |

| | | |
|---|---|---|
| Mark1 | 825MHz | 2.6629 |
| Mark2 | 895MHz | 2.9191 |
| Mark3 | 1.85GHz | 1.6596 |
| Mark4 | 1.99GHz | 1.4042 |

MULTI-BAND ANTENNA

BACKGROUND OF THE INVENTION

1. Field of the Invention

This present invention relates to an antenna, and more specifically to a multi-band antenna mainly applied in a mobile communication device.

2. The Related Art

Currently, the wireless networks operate according to a wide variety of communication standards and/or in a wide range of frequency bands. In order to accommodate multiple frequency bands and/or multiple communication standards, many mobile communication devices, such as mobile phones, portable digital assistants (PDAs) and the like, include a multi-band antenna that covers multiple frequency bands or includes different antennas for each frequency band. However, as the manufacturers continue to design the smaller mobile communication devices, including multiple antennas in one mobile communication device becomes increasingly impractical. Furthermore, with shape and/or volume change of the multi-band antenna, the typical multi-band antenna does not cover all designed frequency bands. Therefore, there remains a need to design a multi-band antenna for addressing the problems mentioned above.

SUMMARY OF THE INVENTION

An object of the invention is to provide a multi-band antenna which has a compact structure and covers multiple frequency bands. The multi-band antenna has a first radiator including a first radiating portion extending upwards and downwards, a second radiating portion extending perpendicularly from an upper portion of one side of the first radiating portion, a third radiating portion extending perpendicularly from an free end of the second radiating portion and located at a same side with respect to the second radiating portion as the first radiating portion, and a fourth radiating portion extending perpendicularly from an end of the third radiating portion and located at a same side with respect to the third radiating portion as the second radiating portion. A second radiator includes a fifth radiating portion in alignment with the first radiating portion, and a sixth radiating portion extending perpendicularly towards the fourth radiating portion from a lower portion of a side of the fifth radiating portion and spaced away from the fourth radiating portion. A feeding portion connects with the first radiating portion and the fifth radiating portion. A grounding portion is spaced away from the first radiating portion, the feeding portion and the fifth radiating portion with a grounding area disposed thereon adjacent to the feeding portion, and connected with an upper portion of the other side of the first radiating portion opposite to the second radiating portion by a connecting portion.

As described above, the structure of the multi-band antenna is compact and simple, which is convenient to assemble and occupies a small space of a mobile communication device. Meanwhile, the first radiator and the second radiator are capable of covering frequency bands of 825 MHz and 1710-2170 MHz, which makes the multi-band antenna capable of receiving and sending electromagnetic signals of the GSM825, DCS1800, PCS1900 and WCDMA2100 and meet use demands.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE EMBODIMENT

Figure 1:
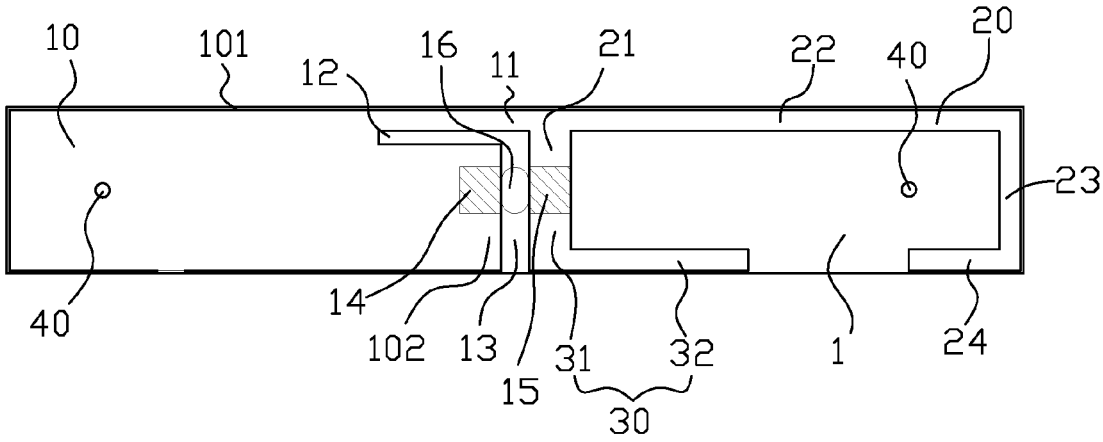
FIG. 1 shows a plan view of a multi-band antenna in accordance with an embodiment of the present invention.

With Reference to FIG. 1, a multi-band antenna of an embodiment according to the present invention mounted in a mobile communication device (not shown) for receiving and transmitting signals is shown. The multi-band antenna may be etched to a basic plate 1 made from a printed circuit board (PCB) and has a grounding portion 10. The basic plate 1 may be manufactured to show a rectangular shape. The grounding portion 10 is substantially a rectangular shape and defines a top edge 101 and a right end 102. The right end 102 has a grounding area 14 at a middle portion thereof and is coated with gold and shows a rectangular shape. A first cavity 12, extending leftward and rightward, is formed between the top edge 101 and the grounding area 14. An upper portion of the right end 102 is extended rightwards to form a connecting portion 11, with a top edge thereof flush with the top edge 101 of the grounding portion 10. The connecting portion 11, which is short and narrow, is connected with a first radiating portion 21 extending upwards and downwards and spaced away from the grounding portion 10. The first radiating portion 21 is oblong. An upper portion of a side of the first radiating portion 21 opposite to the connecting portion 11 is extended back to the connecting portion 11 to form a second radiating portion 22. The second radiating portion 22 is a strip shape and has a length substantially equivalent to a length of the grounding portion 10. A top edge of the second radiating portion 22 is flush with the top edge 101 of the grounding portion 10. A free end of the second radiating portion 22 is bent downwards and extended to form a third radiating portion 23 of strip shape. The third radiating portion 23 has a length substantially equivalent to the width of the grounding portion 10. A distal end of the third radiating portion 23 is extended perpendicularly towards the grounding portion 10 to form a fourth radiating portion 24 of strip shape. The first radiating portion 21, the second radiating portion 22, the third radiating portion 23 and the fourth radiating portion 24 form cooperatively a first radiator 20.

The bottom end of the first radiating portion 21 is connected with a feeding portion 15. The feeding portion 15 is also coated with gold and shows a rectangular shape. A bottom of the feeding portion 15 is connected with a fifth radiating portion 31 of rectangular shape. The fifth radiating portion 31 is in alignment with the first radiating portion 21. A lower portion of a side of the fifth radiating portion 31 opposite to the grounding portion 10 extends back to the grounding portion 10 to form a sixth radiating portion 32. The sixth radiating portion 32 is a strip shape, with a distal end thereof spaced away from the fourth radiating portion 24. The fifth radiating portion 31 and the sixth radiating portion 32 form cooperatively a second radiator 30. A second cavity 13 is formed between the grounding portion 10, the first radiating portion 21, the feeding portion 22 and the fifth radiating portion 31. The second cavity 13 communicates with the first cavity 12 to form a substantially inverted L-shaped cavity together with the first cavity 12. The grounding area 14 and the feeding portion 15 are disposed symmetrically with respect to the second cavity 13. A through hole 16 defined in the basic plate 1 is located in the second cavity 13 between the grounding area 14 and the feeding portion 15 for allowing a wire (not shown) passing therethrough. In this embodiment, the multi-band antenna further has two positioning holes 40, respectively locating at a left end of the grounding portion 10 and the basic plate 1 near the third radiating portion 23, for convenient assembly.

When the multi-band antenna operates at wireless communication, a current is fed from the feeding portion 15 to the first radiator 20 to generate an electrical resonance of a frequency band of 825 MHz for receiving and sending electromagnetic signals of global system for mobile communication (GSM) 825. While the current is fed from the feeding portion 15 to the second radiator 30 to generate an electrical resonance of a frequency band ranging between 1710 MHz and 2170 MHz for receiving and sending electromagnetic signals of digital cellular system 1800 (DCS1800), personal communication system 1900 (PCS1900) and wideband code division multiple access 2100 (WCDMA2100).

Figure 2:
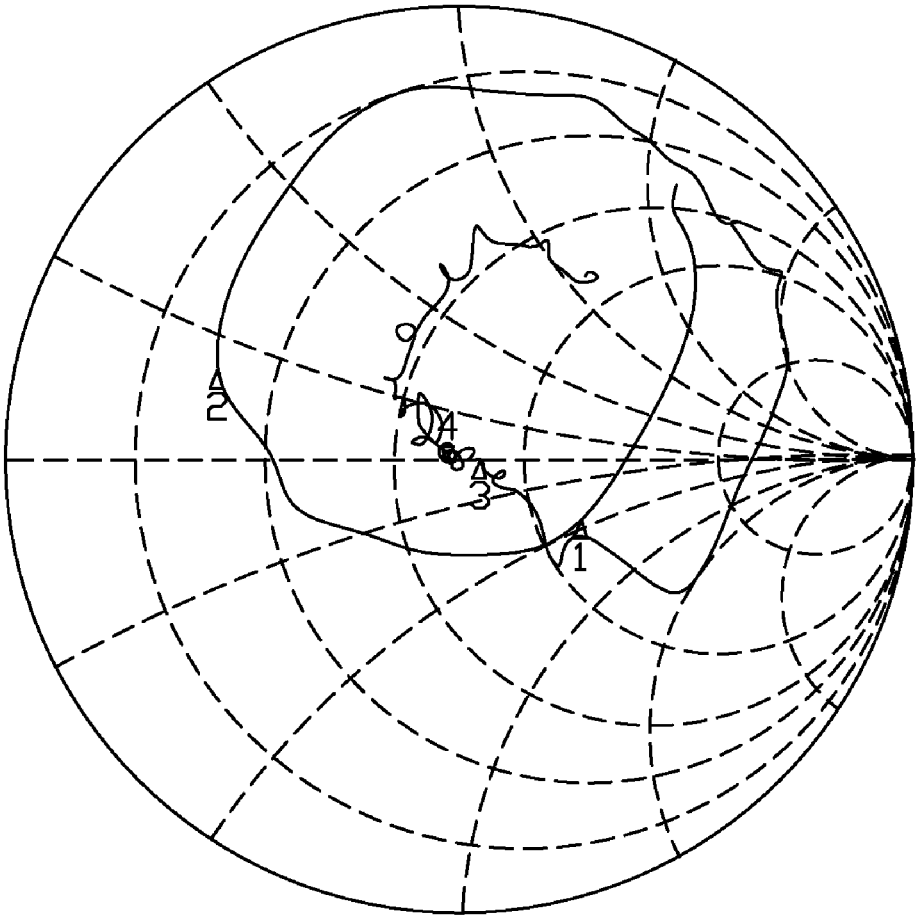
FIG. 2 is a Smith chart recording impedance of the multi-band antenna shown in FIG. 1.

Please refer to FIG. 2, which shows a Smith chart recording impedance of the multi-band antenna in the embodiment when the multi-band antenna operates at wireless communication. The multi-band antenna exhibits an impedance of (127.67−j13.048) Ohm at 825 MHz, an impedance of (18.748+j10.808) Ohm at 895 MHz, an impedance of (83.478−j3.1996) Ohm at 1.85 GHz and an impedance of (68.364−j4.6056) at 1.99 GHz. Therefore, the multi-band antenna has good impedance characteristics.

Figure 3:
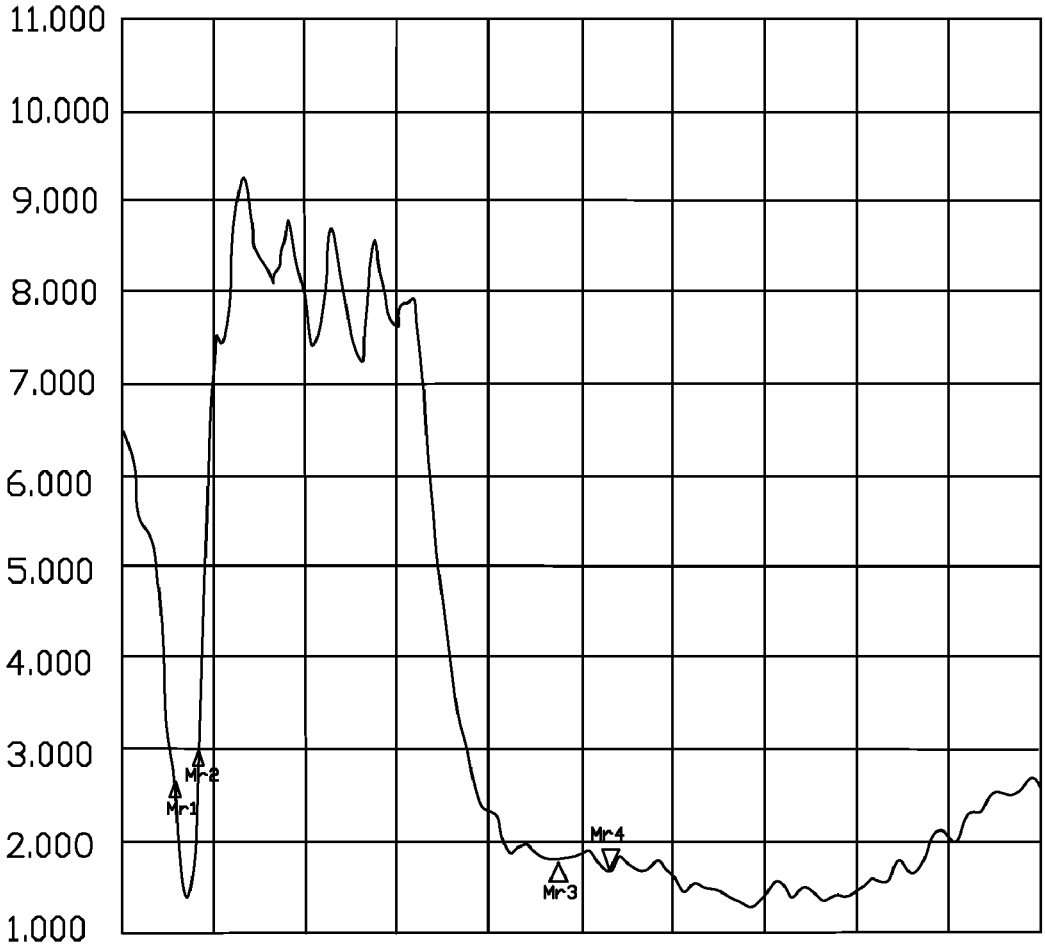
FIG. 3 shows a Voltage Standing Wave Ratio (VSWR) test chart of the multi-band antenna shown in FIG. 1.

Please refer to FIG. 3, which shows a Voltage Standing Wave Ratio (VSWR) test chart of the multi-band antenna in the embodiment when the multi-band antenna operates at wireless communication. When the multi-band antenna operates at 825 MHz (indicator Mr1 in FIG. 3), the VSWR value is 2.6629. When the multi-band antenna operates at 895 MHz (indicator Mr2 in FIG. 3), the VSWR value is 2.9191. When the multi-band antenna operates at 1.85 GHz (indicator Mr3 in FIG. 3), the VSWR value is 1.6596. When the multi-band antenna operates at 1.99 GHz (indicator Mkr4 in FIG. 3), the VSWR value is 1.4042. As seen from above, the multi-band antenna has excellent frequency response.

As described above, the multi-band antenna is formed at the basic plate 1, which is convenient to assemble and occupies a small space of the mobile communication device. Meanwhile, the first radiator 20 and the second radiator 30 are capable of covering frequency bands of 825 MHz and 1710-2170 MHz, which makes the multi-band antenna capable of receiving and sending electromagnetic signals in GSM825, DCS1800, PCS1900 and WCDMA2100 and can meet use demands.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A multi-band antenna, comprising:

a first radiator including a first radiating portion extending up and down, a second radiating portion extending perpendicularly from an upper portion of one side of the first radiating portion, a third radiating portion extending perpendicularly from a free end of the second radiating portion and located at a same side with respect to the second radiating portion as the first radiating portion, and a fourth radiating portion extending perpendicularly from an end of the third radiating portion and located at a same side with respect to the third radiating portion as the second radiating portion;

a second radiator including a fifth radiating portion in alignment with the first radiating portion, and a sixth radiating portion extending perpendicularly towards the fourth radiating portion from a lower portion of a side of the fifth radiating portion and spaced away from the fourth radiating portion;

a feeding portion connecting with the first radiating portion and the fifth radiating portion; and a grounding portion spaced away from the first radiating portion, the feeding portion and the fifth radiating portion with a grounding area disposed thereon adjacent to the feeding portion, and connected with an upper portion of the other side of the first radiating portion opposite to the second radiating portion by a connecting portion.

2. The multi-band antenna as claimed in claim 1, wherein the multi-band antenna is etched on a basic plate made from a printed circuit board.

3. The multi-band antenna as claimed in claim 1, wherein the grounding portion has a first cavity formed at an end thereof adjacent to the connecting portion and extending parallel to the second radiating portion, a second cavity defined between the grounding portion, the first radiating portion, the feeding portion and the fifth radiating portion, and communicates with the first cavity to form a substantially inverted-L shape.

4. The multi-band antenna as claimed in claim 3, wherein a through hole defined in a basic plate where the multi-band antenna is etched is located in the second cavity.

5. The multi-band antenna as claimed in claim 1, wherein the feeding portion and the grounding area are coated with gold.

6. The multi-band antenna as claimed in claim 1, wherein top edges of the grounding portion, the connecting portion and the second radiating portion are substantially in alignment.

7. The multi-band antenna as claimed in claim 1, wherein the grounding portion has a length substantially equivalent to that of the second radiating portion, and a width substantially equivalent to a length of the third radiating portion.

8. The multi-band antenna as claimed in claim 1, wherein bottom edges of the grounding portion and the sixth radiating portion and the fourth radiating portion are substantially in alignment.

* * * * *